US007712302B2

(12) United States Patent
Nichols et al.

(10) Patent No.: US 7,712,302 B2
(45) Date of Patent: May 11, 2010

(54) CROSSFIRE TUBE ASSEMBLY FOR GAS TURBINES

(75) Inventors: Richard Lee Nichols, Greenville, SC (US); Sarah Jane Hutcherson, Greer, SC (US); Keith Cletus Belsom, Laurens, SC (US); Thomas Charles Almond, III, Simpsonville, SC (US); Natesh Chandrashekar, Greenville, SC (US); Alberto Negroni, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1163 days.

(21) Appl. No.: 11/325,304

(22) Filed: Jan. 5, 2006

(65) Prior Publication Data

US 2007/0151260 A1 Jul. 5, 2007

(51) Int. Cl.
*F02C 7/264* (2006.01)
*F02C 7/20* (2006.01)

(52) U.S. Cl. ..... 60/39.821; 60/800

(58) Field of Classification Search ..... 60/39.821, 60/804, 800, 39.37
See application file for complete search history.

(56) References Cited

U.S. PATENT DOCUMENTS 2,722,803 A * 11/1955 Travers ..... 60/39.37
3,492,030 A * 1/1970 Harrison et al. ..... 285/300
4,241,895 A * 12/1980 Sternenberg et al. ..... 251/173
4,249,372 A 2/1981 White
4,449,581 A 5/1984 Blystone et al.
5,361,577 A * 11/1994 Cromer ..... 60/800
5,706,885 A 1/1998 Kim
5,975,199 A 11/1999 Park et al.
6,606,865 B2 8/2003 Tilson et al.
7,013,634 B2 * 3/2006 Pidcock et al. ..... 60/39.821

* cited by examiner

*Primary Examiner*—Michael Cuff
*Assistant Examiner*—Gerald L Sung
(74) *Attorney, Agent, or Firm*—Nixon & Vanderhye, P.C.

(57) ABSTRACT

A crossfire tube for attachment between casing bosses of combustors includes a bellows assembly having a bellows with opposite cylindrical ends welded to annular flanges. The annular flanges include a bolt circle for securing the flanges to the combustor bosses. The flanges bear against a gasket for sealing against inserts welded to the casing bosses for retrofit in the sealing assembly to combustors or to seats where the inserts and bosses are formed integrally during original equipment manufacture. A telescoping cylindrical sleeve surrounds the bellows to protect from falling foreign object damage.

5 Claims, 2 Drawing Sheets

CROSSFIRE TUBE ASSEMBLY FOR GAS TURBINES

BACKGROUND OF THE INVENTION

The present invention relates to a crossfire tube assembly for gas turbines and particularly relates to a crossfire tube assembly having a gasket/bellows combination for air tight sealing of the crossfire tube assembly.

As well known, combustors in stationary land based gas turbines are interconnected by crossfire tubes. These crossfire tubes enable initial ignition of a combustor adjacent to an ignited combustor thereby eliminating the need for separate ignition, and corresponding elements for enabling separate ignition, from each combustor. Crossfire tubes are well known in the gas turbine environment. See for example U.S. Pat. Nos. 4,249,372 and 6,606,865. In the system disclosed in the latter patent, a bellows with annular rings at opposite ends is arranged between combustor flanges. While those bellows assemblies have performed and have demonstrated significant improvement over prior crossfire tube assemblies, the sealing capability of prior crossfire tube assemblies of this type has been brought into question. Absent an air tight seal, hot gases escaping from the crossfire tubes may damage adjacent parts of the turbine. Accordingly there has been demonstrated a need for an improved sealing system for a crossfire tube assembly whereby the crossfire tube assembly is completely airtight with effective thermal disassociation between the hot gases flowing through the crossfire tube assembly and adjacent components of the turbine.

BRIEF DESCRIPTION OF THE INVENTION

In a preferred embodiment of the present invention, there is provided a crossfire tube connection between casing bosses of adjacent combustors in a gas turbine comprising a pair of annular metallic inserts engaged with respective casing bosses, each annular metallic insert formed with an annular recess; a bellows assembly including a bellows having a plurality of axially-spaced convolutions about an axis; and flanges sealed to respective opposite ends of the bellows; gaskets located in respective ones of the annular recesses in sealing engagement with the flanges and the annular metallic inserts at respective opposite ends of the bellows assembly; and means securing the flanges to the casing bosses at opposite ends of the bellows assembly whereby the crossfire tube is sealed between adjacent combustors.

In another preferred embodiment, there is provided a combustor and crossfire tube assembly comprising a pair of combustor bosses spaced from one another; each of the bosses including an annular seat; a bellows assembly between the bosses and including a bellows and annular flanges sealed to the bellows at respective opposite ends of the bellows; gaskets between the seats and the flanges at respective opposite ends of the bellows assembly for sealing between the flanges and the seats; the flanges and the bosses having annular bolt rings and bolts securing the flanges and bosses to one another.

DETAILED DESCRIPTION OF THE INVENTION

Figure 1:
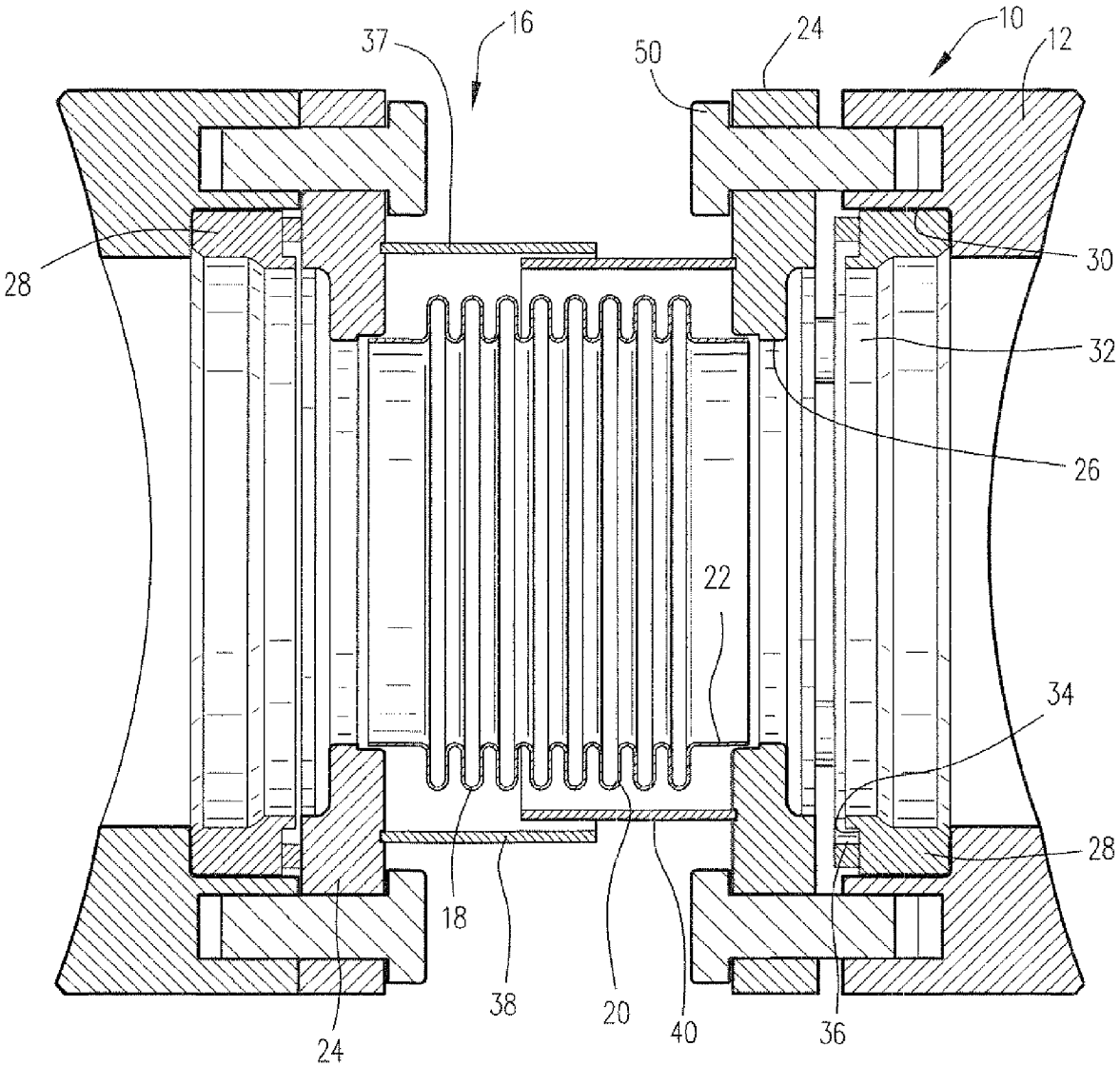
FIG. 1 is a cross-sectional view of a bellows type outer crossfire tube assembly in accordance with a preferred embodiment of the present invention with parts in full and partially assembled positions.
Figure 2:
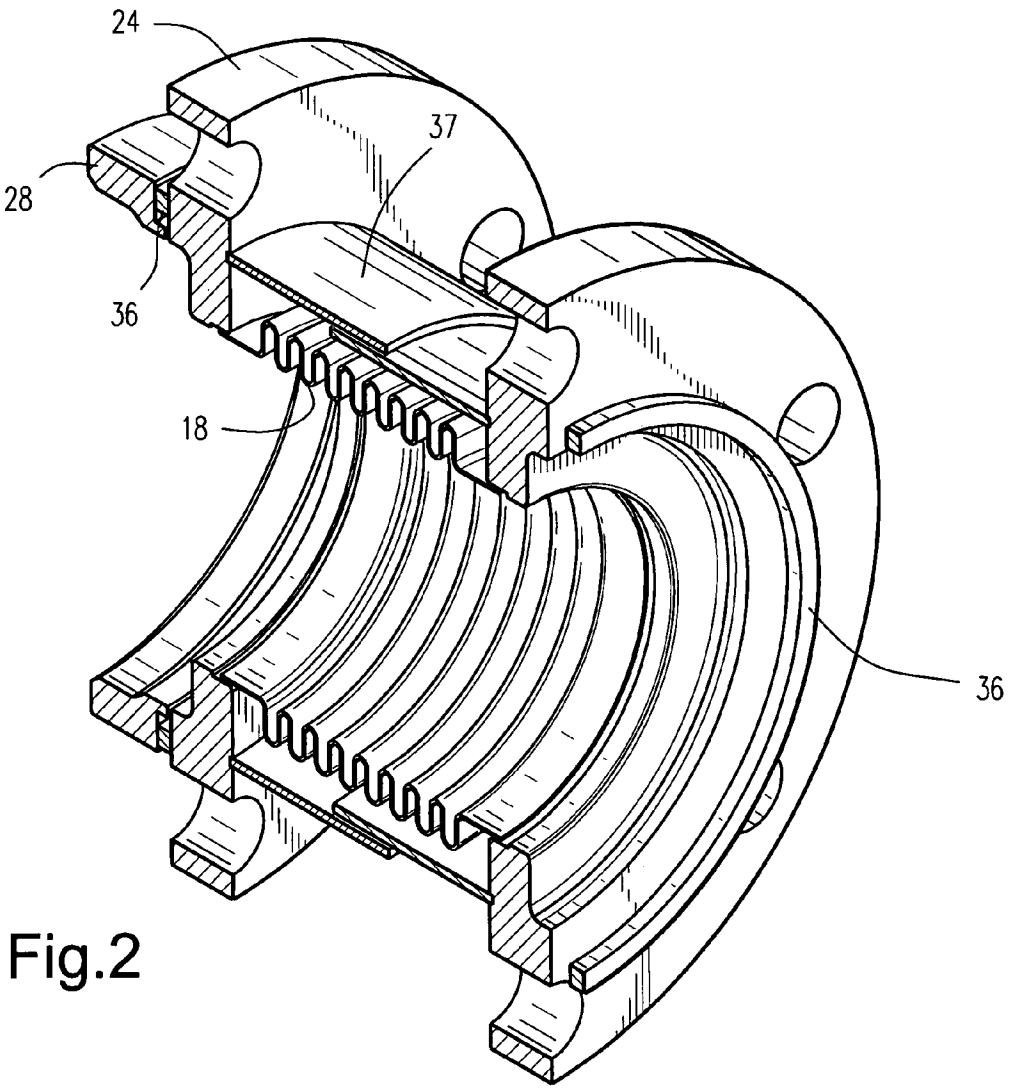
FIG. 2 is a fragmentary perspective view with parts broken out in cross-section of the assembly of FIG. 1.

Referring to the drawings particularly to FIG. 1, there is illustrated an outer crossfire tube assembly generally designated 10 arranged between a pair of casing bosses 12 of adjacent combustors in a gas turbine. The bosses 12 are annular in nature and have facing bolt circle holes for securement of the crossfire tube assembly between the casing bosses. Arranged between the casing bosses 12 is an outer crossfire bellows assembly generally designated 16. Bellows assembly 16 includes a bellows 18 having inner and outer diameters defined by axially spaced convolutions 20. The bellows assembly 18 lies generally co-axial with and between the casing bosses 12 and terminates at opposite ends in cylindrical sections 22. A pair of annular flanges 24 are provided, each having an internal cylindrical opening 26 for receiving an end 22 of the bellows 18. The ends 22 of bellows 18 are sealed to the flanges 24, for example, by fillet type welds between the bellow's ends and the flanges forming an airtight seal.

Also illustrated in the drawing figures is a pair of annular inserts 28 received in recessed annular shoulders 30 of the casing bosses 12. The inserts 28 have an interior cylindrical opening 32 in excess of the diameter of the ends of the bellows. The inserts 32 also include an annular recess 34 facing the bellows assembly 16. A spiral gasket 36 is provided in a recess 34 between the annular face of the flange 24 and the insert 28, the recess 34 being preferably located on the inserts 28. The gasket 36 is formed of a thermicullite material commercially available.

Additionally, the annular surfaces of the flanges 24 which axially face and align with one another also mount a sleeve 37. Particularly, the sleeve is formed of a pair of telescoping concentric cylinders 38 and 40, each secured at one end particularly by welding to the flange 24. As illustrated in FIG. 1, the cylindrical sleeve 38 is larger in diameter than the cylindrical sleeve 40 such that the sleeves may telescope relative to one another on movement of the combustor bosses 12 relative to one another. Also, there is an inner crossfire tube, not shown, which passes between the combustor bosses and axially along the bellows assembly 16 and through which the actual ignition gases flow for igniting the adjacent combustor from a previously ignited combustor. It will also be appreciated that in final assembly, the bellows assembly is secured to the casing bosses by bolt circles and bolts 50 passing through the bolt openings through the flanges 24 for reception in bolt sockets in the casing bosses. Consequently, when the opposite ends of the bellows assembly is secured to the combustion bosses, the flanges bear against and compress the gaskets 36 into sealing engagement with the inserts 28.

It will appreciated that the inserts 28 may be formed integral with the casing bosses 12. Thus for original equipment manufacture, the inserts may comprise part of the casing bosses and form a seat for the gaskets 36. For retrofit applications, the inserts 28 are welded to the interior of the casing bosses.

With the foregoing described arrangement, it will be appreciated that the bellows assembly can be readily and easily installed between the combustor casing bosses and removed to replace the seals as needed. Thus, by unbolting the flanges 24 from the casing bosses, the bellows assembly 16 can be removed from between the bosses. While the advantages of ready and easy installation and removal of the bellows assembly are obtained, it will also be appreciated that an airtight seal is provided between the casing bosses. The seal in the retrofit configuration illustrated with discrete inserts 28 is provided by the welding of the seats 28 to the casing bosses, the welding of the opposite ends of the bellows 18 to the flanges 24 and the compression of the gaskets 36 between the flanges 24 and the inserts 28. Thus only the spirally wound gasket 36 is required for sealing the bellows assembly to either the insert 28 or the seat in the bosses when the bosses and the inserts are formed integrally as in an original equipment manufacturer.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cross fire tube connection between casing bosses of adjacent combustors in a gas turbine comprising: a pair of annular metallic inserts engaged with respective casing bosses, each annular metallic insert formed with an annular recess; a bellows assembly including a bellows having a plurality of axially-spaced convolutions about an axis; flanges sealed to respective opposite ends of the bellows; gaskets located in respective ones of said annular recesses, in sealing engagement with said flanges and said annular metallic inserts at respective opposite ends of the bellows assembly; and means securing said flanges to said casing bosses at opposite ends of the bellows assembly whereby the crossfire tube is sealed between adjacent combustors.

2. The crossfire tube connection according to claim 1 including a sleeve about the bellows and between the flanges.

3. The crossfire tube connection according to claim 2 wherein the sleeve includes a pair of telescopically related cylinders secured at opposite ends to the respective flanges.

4. The crossfire tube connection according to claim 1 wherein said flanges and said opposite ends of said bellows are welded to one another forming a seal.

5. The crossfire tube connection according to claim 1 wherein said bellows is formed of metal.

* * * * *

UNITED STATES PATENT AND TRADEMARK OFFICE

CERTIFICATE OF CORRECTION

PATENT NO. : 7,712,302 B2
APPLICATION NO. : 11/325304
DATED : May 11, 2010
INVENTOR(S) : Richard Lee Nichols et al.

It is certified that error appears in the above-identified patent and that said Letters Patent is hereby corrected as shown below:

Title page of Patent No. 7,712,302 at INID code (75), line 4 of the Inventors, delete "Almond, III" and insert --Amond, III--

Signed and Sealed this
Twenty-ninth Day of March, 2011

David J. Kappos

David J. Kappos
*Director of the United States Patent and Trademark Office*